US010153074B2

(12) United States Patent
Hiltner et al.

(10) Patent No.: US 10,153,074 B2
(45) Date of Patent: Dec. 11, 2018

(54) SUPPORT AND FASTENER FOR POLARIZATION RESISTORS OF ON-LOAD TAP CHANGER

(71) Applicant: Maschinenfabrik Reinhausen GmbH, Regensburg (DE)

(72) Inventors: Robert Hiltner, Bernhardswald (DE); Thomas Schuster, Mitterskirchen (DE); Moritz Bengler, Regensburg (DE)

(73) Assignee: MASCHINENFABRIK REINHAUSEN GMBH, Regensburg (DE)

( * ) Notice: Subject to any disclaimer, the term of this patent is extended or adjusted under 35 U.S.C. 154(b) by 35 days.

(21) Appl. No.: 15/031,516

(22) PCT Filed: Nov. 10, 2014

(86) PCT No.: PCT/EP2014/074141
§ 371 (c)(1),
(2) Date: Apr. 22, 2016

(87) PCT Pub. No.: WO2015/074904
PCT Pub. Date: May 28, 2015

(65) Prior Publication Data

US 2016/0284448 A1 Sep. 29, 2016

(30) Foreign Application Priority Data

Nov. 25, 2013 (DE) ..... 10 2013 019 595

(51) Int. Cl.
*H01C 13/02* (2006.01)
*H01H 9/00* (2006.01)

(52) U.S. Cl.
CPC ..... *H01C 13/02* (2013.01); *H01H 9/0005* (2013.01); *H01H 9/0044* (2013.01)

(58) Field of Classification Search
CPC .... H01C 13/02; H01H 9/0005; H01H 9/0044; H01F 29/04
(Continued)

(56) References Cited

U.S. PATENT DOCUMENTS 6,246,312 B1 * 6/2001 Poole ..... H01C 13/02 338/307
7,909,633 B1 * 3/2011 Miller ..... H01R 4/305 439/441
(Continued)

FOREIGN PATENT DOCUMENTS

CN 202585167 U 5/2012
DE 2931000 * 2/1981 ..... H01F 29/04
(Continued)

*Primary Examiner* — Kyung Lee
*Assistant Examiner* — Iman Malakooti
(74) *Attorney, Agent, or Firm* — Andrew Wilford

(57) ABSTRACT

A support module (10) for polarization resistors of an on-load tap changer comprises:—a supporting region (11) for at least one polarization resistor; —a first joint region (13); —a second joint region (14) which is compatible with the first joint region. A support frame (19) for polarization resistors of an on-load tap changer comprises:—two such support modules which are joined by virtue of the second joint region of the first support module bearing at least partially against the first joint region of the second support module. A fastening element (24) for polarization resistors (22) comprises:—two electrically conductive accommodating sections (25), which each have an accommodating opening (27) for one of the ends (23) of a polarization resistor (22);—an electrically conductive connecting section (26), which connects the two accommodating sections (25) mechanically and electrically to one another;—a first piece (28.1), which comprises the first accommodating section (25.1) and an adjoining first part of the connecting section (26); —a second piece (28.2), which comprises the second
(Continued)

accommodating section (25.2) and an adjoining second part of the connecting section (26); wherein:—the first and second parts are in the form of a plug-type connection.

5 Claims, 5 Drawing Sheets

(58) Field of Classification Search
USPC ..... 338/320
See application file for complete search history.

(56) References Cited

U.S. PATENT DOCUMENTS

| | | | | | |
|---|---|---|---|---|---|
| 2009/0212900 | A1* | 8/2009 | Szwarc | ..... | H01C 1/14<br>338/320 |
| 2010/0090794 | A1* | 4/2010 | Nilsson | ..... | H01C 1/01<br>338/261 |

FOREIGN PATENT DOCUMENTS

| | | | | | |
|---|---|---|---|---|---|
| DE | 2931000 | A | | 2/1981 | |
| DE | 2931000 | A1 | | 2/1981 | |
| DE | 2931000 | C2 | | 4/1987 | |
| DE | 3644206 | A | | 7/1988 | |
| DE | 8914598 | | * | 12/1989 | ..... H01F 29/04 |
| DE | 9101959 | | * | 2/1991 | ..... E04F 15/10 |
| DE | 8914598 | U1 | | 4/1991 | |
| DE | 9101959 | U1 | | 4/1991 | |
| DE | 8914598.4 | U | | 5/1991 | |
| DE | 9101959.1 | U | | 8/1991 | |
| GB | 1514104 | B | | 6/1978 | |

* cited by examiner

SUPPORT AND FASTENER FOR POLARIZATION RESISTORS OF ON-LOAD TAP CHANGER

CROSS REFERENCE TO RELATED APPLICATIONS

This application is the US-national stage of PCT application PCT/EP2014/074141 filed 10 Nov. 2014 and claiming the priority of German patent application 102013019595.0 itself filed 25 Nov. 2013 and PCT patent application PCT/EP2014/074141 itself filed 10 Nov. 2014.

BACKGROUND OF THE INVENTION

The invention relates to a support module and support structure for polarity resistors of a tap changer, to a fastener for polarity resistors and to an assembly of polarity resistors of a tap changer.

BACKGROUND OF THE INVENTION

DE 25 48 408 [GB 1,514,104] describes a tap changer that consists of a load changeover switch, tap selector and preselector and in which a polarity switch is provided below the tap selector coaxially therewith. The polarity switch consists of an insulating cylinder arranged below the tap selector. A plurality of plug contacts is on the inner wall of the insulating cylinder on a helix and a respective rod-shaped porcelain resistor is inserted into each two of these plug contacts.

DE 29 31 000 describes a tap changer in which a cylindrical load changeover switch is carried by a tap switch head and in which, in addition, a support—that is matched to the cylindrical shape of the tap changer—for polarity resistors is outside the circumference of the load changeover switch. According to a first alternative, the support consists of at least two insulating-material rings of the same circumference that are around the load changeover switch at an axial spacing, wherein rod-shaped polarity resistors extending in the direction of the cylinder wall of the load changeover switch are insertable into plug contacts seated at the insulating-material rings. According to a second alternative, the support is constructed as a switch part of insulating material that in circumference covers approximately ¼ to ⅓ of the circumference of the tap changer and supports the polarity resistors at its inner side.

DE 36 44 206 describes a multi-phase load selector for tapped transformers with a reverser arranged laterally of the load selector, wherein the reverser extends over the entire height of the load selector and is constructed as a segment of a tube. Several rod-shaped polarity resistors connected into a series circuit are provided on both sides of the tube segment in a zigzag line through the wall.

DE 89 14 598 U1 describes a fastener for polarity resistors at tap changer of tapped transformers, which fastener serves for fastening of the resistors on or to insulating-material cylinders, segments or other insulating fastening means and at the same time for electrical connection of each end of the rod-shaped polarity resistors with an electrical potential, wherein the fastener consists integrally of an electrically conductive material and has an outer, approximately spherical profile, in which a cylindrical opening extends, the diameter of the opening being slightly larger than the shank diameter of the polarity resistors to be fixed, wherein provided perpendicularly to the longitudinal axis of this opening in cut-outs of the fastener are presser bodies that are at a defined angle relative to one another and are guided to be radially movable and that are urged into the interior of the opening by means of compression springs, and wherein a threaded bore, into which a bolt for fastening and electrical contact-making can be screwed, is present in the fastener and radially penetrates the wall thereof.

OBJECT OF THE INVENTION

It is an object of the invention to design the mounting of polarity resistors in a tap changer to be simple and flexible.

SUMMARY OF THE INVENTION

According to a first aspect of the invention, a support module for polarity resistors of a tap changer comprises:

a support region for at least one polarity resistor;

a first connecting face; and a second connecting face that fits or adapted to fit the first connecting face, preferably in such a way that it can at least partly bear against the first connecting face of another, constructionally identical support module in order to join, assemble or hold together these two support modules.

This support module proposed in accordance with the first aspect enables, as a form of base module in a module construction system or modular system, a simple and flexible mounting, assembly and retention of the polarity resistors in a tap changer.

The proposed support module can be constructed in any desired mode and manner according to need and, for example, have at least one further support region and/or at least one further connecting face and/or, for example, can be produced from an electrically non-conductive or electrically insulating material and/or from ceramic and/or from glass and/or from thermoplastic plastics material and/or from thermosetting plastics material and/or by injection molding.

According to the invention: the first connecting face and the second connecting face are on opposite sides of the support module.

Each of the proposed support modules has or comprises:

a third connecting face; and a fourth connecting face that fits or is adapted to the third connecting face, preferably in such a way that it can bear at least partly against the third connecting face of another, constructionally identical support module in order to join, assemble or hold together these two support modules.

These third and fourth connecting faces enable connection of support modules in a second direction or dimension by comparison with a first direction or dimension defined by the first and second connecting faces.

The respective mutually compatible or matched connecting faces can be constructed in any desired mode and manner according to need, for example at least partly as a plug connection and/or at least partly as a detent connection and/or at least partly as a snap connection.

In accordance with the invention:

the third connecting face and the fourth connecting face are on opposite sides of the support module, and each of the proposed support modules has or comprises:

an additional support region for at least one polarity resistor.

It can be provided that:

the support regions are on opposite sides of the support module.

It can be provided that:

each support region is between the first and the second connecting faces and/or between the third and fourth connecting faces and/or connects the first connecting face with the second connecting face and/or the third connecting face with the fourth connecting face.

It can be provided that:

the first and second connecting faces and/or the third and fourth connecting faces are constructed at least partly as a dovetail connection and/or at least partly as a groove-and-key connection and/or at least partly as a tongue-and-groove connection.

According to a second aspect the invention proposes a support structure for polarity resistors of a tap changer, having or comprising:

two support modules that are each constructed as, in particular, one of the proposed support modules and that each have or comprise:

a support region for at least one polarity resistor;

a first connecting face; and a second connecting face that fits or is adapted to the first connecting face preferably in such a way that it can at least partly bear against the first connecting face of the other support module in order to join, assemble or hold together these two support modules;

wherein:

the support modules are joined, assembled or held together in that the second connecting face of the first support module or of one support module bears at least partly against the first connecting face of the second support module or of the other support module.

This support structure proposed in accordance with the second aspect enables, by virtue of its modular construction, a simple and flexible mounting, assembly and retention of the polarity resistors in a tap changer.

The proposed support structure can be constructed in any desired mode and manner according to need and, for example, comprise at least one further support module.

The proposed support structure can be integrated as a so-called single-phase polarity tower in a single-phase tap changer or be assembled together with two additional constructionally identical support structures to form a so-called three-phase polarity tower and integrated in a three-phase tap changer. However, it can also be mounted in any desired place in the housing of a power transformer and electrically connected with a tap changer similarly located in the housing, which is also termed 'polarity on plate'.

The proposed assembly can be constructed in any desired mode and manner according to need and, for example, comprise at least one further polarity resistor and/or at least one further support structure. Thus, for example, an individual support structure can be provided for each phase of a three-phase tap changer, in which case these three support structures are preferably constructionally identical and/or preferably connected with one another and/or with other structures of the tap changer by way of connecting plates and/or connecting struts and/or additional support modules that then do not carry polarity resistors.

It can be provided that each of the proposed support structures has or comprises:

a third support module that is constructed as, in particular, one of the proposed support modules;

wherein:

each support module has or comprises:

a third connecting face; and a fourth connecting face that fits or is adapted to the third connecting face, preferably in such a way that it can at least partly bear against the third connecting face of one of the other support modules so as to join, assemble or hold together these two support modules;

and the third support module and one of the other support modules are joined, assembled or held together in that the fourth connecting face of the third support module at least partly bears against the third connecting face of this other support module.

These third and fourth connecting faces enable connection of the third support module with the first or second support module in a second direction or dimension by comparison with a first direction or dimension defined by the first and second connecting faces.

Each support module can be constructed in any desired mode and manner according to need, for example as one of the support modules proposed in accordance with the first aspect.

It can be provided that each of the proposed support structures has or comprises:

at least one locking element that engages two joined support modules in such a way that it prevents detaching of these support modules.

This locking element can be constructed in any desired mode and manner according to need, for example as a screw, pin, dowel pin, grooved pin, split pin, stud, clip or clamp, and/or consist of, for example, metal and/or plastic.

According to a third aspect the invention proposes a fastener for polarity resistors that each have two electrically conductive ends, particularly for fastening polarity resistors to a support module that is constructed as one of the proposed support modules, or to a support structure that is constructed as, in particular, one of the proposed support structures, having or comprising:

two electrically conductive sockets that each have a respective seat for one of the ends of a polarity resistor;

an electrically conductive connecting section that mechanically and electrically connects the two sockets together;

a first portion that comprises, includes or has the first socket and a first part thereadjacent of the connecting section; and a second portion that comprises, includes or has the second socket and a second part thereadjacent of the connecting section;

wherein:

the first and second parts are constructed as a plug connection.

This fastener proposed in accordance with the third aspect enables, by virtue of its divided construction, simple electrical contact-making, mounting, assembly and retention of the polarity resistors at a support module that can be constructed as, in particular, one of the support modules proposed in accordance with the first aspect, or support structure that can be constructed as, in particular, one of the support structures proposed in accordance with the second aspect. It additionally makes possible a simple and rapid removal of an individual one of a plurality of polarity resistors mounted on a support module in the support structure without the adjacent or remaining polarity resistors having to be removed.

It can be provided that:

the free end that is remote from the first socket, of the first part is constructed as a stud; and the free end that is remote from the second socket, of the second part has a hole for reception of the stud.

The stud can be constructed in any desired mode and manner according to need, for example to be cylindrical and/or adapted to or compatible with the hole. The hole can be formed in any desired mode and manner according to need, for example as a blind bore and/or cylindrical. Stud and hole preferably have a clearance fit.

It can be provided that:

an encircling groove is formed in the circumferential surface of the stud and/or in the circumferential wall of the hole; and a securing ring and/or spring ring and/or a securing washer is seated in at least one of the grooves.

It can be provided that:

the first portion has or comprises a socket body that comprises, includes or has the first socket, and a connecting member that comprises, includes or has the first part of the connecting section and is fastened to or mounted on the socket body; and/or the second portion has or comprises a socket body that comprises, includes or has the second socket, and a connecting member that forms the second part of the connecting section and is fastened to or mounted on the socket body.

It can be provided that in the case of at least one of the portions:

the socket body has a hole with an internal thread; and the free end that is near the socket body, of the connecting member is formed as a stud with an external thread for engagement in the internal thread.

It can be provided that in at least one of the portions:

the hole of the socket body is a passage that opens into the seat and is shorter than the stud of the connecting member.

As a result, the stud can be screwed into the hole to such an extent that it protrudes by its free end into the seat and bears against an end that is pushed into the seat, of a polarity resistor so as to firmly clamp this in the socket body.

According to a fourth aspect the invention proposes an assembly of polarity resistors of a tap switch, having or comprising:

two polarity resistors that each have two electrically conductive ends; and a support structure that is constructed as, in particular, one of the proposed support structures and has or comprises the two support modules that are each constructed as, in particular, one of the proposed support modules and that each have or comprise:

a first support region for at least one polarity resistor;

a second support region for at least one polarity resistor;

a first connecting face; and a second connecting face that fits or is adapted to the first connecting face;

wherein:

the support modules are joined, assembled or held together in that the second connecting face of the first support module or of one support module at least partly bears against the first connecting face of the second support module or the other support module;

in each support module the connecting faces are on opposite sides of the support module;

in each support module the support regions are on opposite sides of the support module;

in each support module each support region is between the connecting faces and/or connects the connecting faces together;

the first polarity resistor is fastened to or mounted on the first support region of the first support module;

the second polarity resistor is fastened to or mounted on the second support region of the first support module and/or the second support region of the second support module;

the first end of the second polarity resistor lies closer to the second end of the first polarity resistor than to the first end of the first polarity resistor and is connected with this second end; and the second end of the second polarity resistor lies closer to the first end of the first polarity resistor than to the second end of the first polarity resistor.

This assembly proposed in accordance with the fourth aspect makes possible, by virtue of its modular construction, a simple and flexible mounting, assembly and retention of the polarity resistors in a tap changer.

The proposed assembly can be constructed in any desired mode and manner according to need and comprise, for example, at least one further polarity resistor and/or at least one further support structure. Thus, for example, an individual support structure can be provided for each phase of a three-phase tap changer, wherein these three support structures are preferably constructionally identical and/or preferably connected with one another and/or with other structures of the tap changer by way of connecting plates and/or connecting struts and/or additional support modules that then do not carry polarity resistors.

Each support structure can be constructed in any desired mode and manner according to need, for example as one of the support structures proposed in accordance with the second aspect.

Each support module can be constructed in any desired mode and manner according to need, for example as one of the support modules proposed in accordance with the first aspect.

Each polarity resistor can be constructed in any desired mode and manner according to need, for example as a porcelain resistor and/or to be of rod-shaped form.

It can be provided that each of the proposed assemblies has or comprises:

a third polarity resistor that has two electrically conductive ends;

wherein:

the third polarity resistor is fastened to or mounted on the first support region of the second support module; and the first end of the third polarity resistor lies closer to the second end of the second polarity resistor than to the first end of the second polarity resistor and is connected with this second end.

It can be provided that each of the proposed assemblies has or comprises:

a fourth polarity resistor that has two electrically conductive ends;

wherein:

the second polarity resistor is fastened to the second support region of the first support module;

the fourth polarity resistor is fastened to the second support region of the second support module;

the first end of the fourth polarity resistor lies closer to the second end of the third polarity resistor than to the first end of the third polarity resistor and is connected with this second end.

It can be provided that:

each polarity resistor is fastened by its ends to the support structure.

Alternatively or additionally, each polarity resistor can be fastened according to need by a center region that lies between its ends, to the support structure.

It can be provided that each of the proposed assemblies has or comprises:

for each polarity resistor two fasteners that are each constructed as, in particular, one of the proposed fasteners and that have:

two electrically conductive sockets that each have a receiving opening for an end of one of the polarity resistors; and an electrically conductive connecting section that mechanically and electrically connects the two sockets together;

wherein:

each support module has two passages that each extend from the first to the second support region and can receive the connecting section of one of the fasteners in such a way that the first socket of the fastener lies in the first support region of the support module and the second socket of the fastener lies in the second support region of the support module.

Each fastener can be constructed in any desired mode and manner according to need, for example as one of the fasteners proposed in accordance with the third aspect.

It can be provided that:

a first and a second fastener are received in the passages of the first support module;

a third fastener is received in one of the passages of the second support module;

the first polarity resistor is seated by its first end in the first seat of the first fastener and by its second end in the first seat of the second fastener; and the second polarity resistor is seated by its first end in the second seat of the second fastener and by its second end in the second seat of the third fastener.

It can be provided that:

a first and a second fastener are received in the passages of the first support module;

a third and a fourth fastener are received in the passages of the second support module;

the first polarity resistor is seated by its first end in the first seat of the first fastener and by its second end in the first seat of the second fastener;

the second polarity resistor is seated by its first end in the second seat of the third fastener and by its second end in the second seat of the fourth fastener; and the third fastener is connected with the second fastener.

The descriptions and explanations with respect to one of the aspects of the invention, particularly with respect to individual features of this aspect, correspondingly also apply analogously to the other aspects of the invention.

BRIEF DESCRIPTION OF THE DRAWING

Embodiments of the invention are explained in more detail in the following by way of example on the basis of the accompanying drawings. However, the individual features evident therefrom are not restricted to the individual embodiments, but can be connected and/or combined with individual features described further above and/or with individual features of other embodiments. The details in the drawings are to be understood as merely explanatory, but not as limiting. In the drawings.

SPECIFIC DESCRIPTION OF THE INVENTION

Figure 1A:
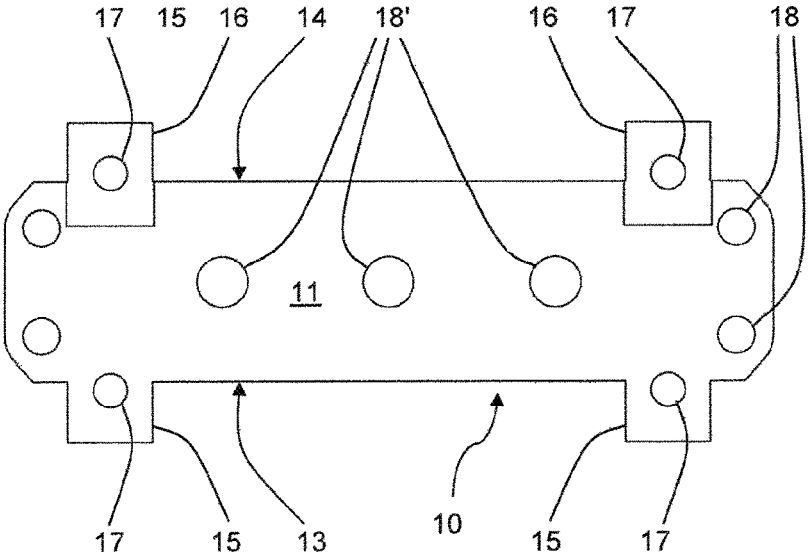
FIGS. 1A and 1B are side and perspective views of an embodiment of a support module for polarity resistors of a tap changer.
Figure 1B:
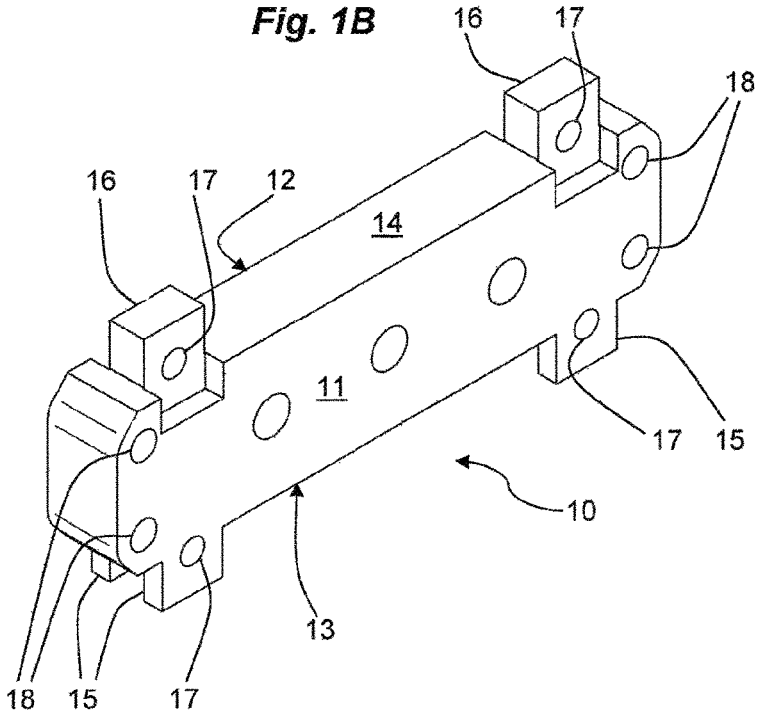

An embodiment of a support module 10 for polarity resistors (FIGS. 3A and 3B), which are not illustrated, of a tap changer (not illustrated) is schematically depicted in FIGS. 1A and 1B. The support module 10 has a first support region 11 and second support region 12 each for at least one polarity resistor and a first connecting face 13 and second connecting face 14. The second connecting face 14 fits and/or is adapted to the first connecting face 13. This support module 10 comprises a unitary base body of injection-molded polyethylene (PE), at which the different regions 11 to 16 are formed.

In this embodiment the first connecting face 13 and second connecting face 14 are on opposite sides of the support module 10, namely at the bottom and top in FIGS. 1A and 1B, and the first support region 11 and second support region 12 are on other, opposite sides of the support module 10, namely at the front and back in FIGS. 1A and 1B. The support regions 11, 12 are thus arranged between the connecting faces 13, 14 and connect these together.

In this embodiment the connecting faces 13, 14 are formed as a tongue-and-groove joint in that the first connecting face 13 has at each of its ends at the left and right in FIGS. 1A and 1B two downwardly projecting right-angled legs 15 that bound therebetween a groove for the tongue-and-groove joint, and the second connecting face 14 has at each of its ends on the left and right in FIGS. 1A and 1B a respective upwardly protruding right-angled leg 16, which legs each form a respective key for the tongue-and-groove joint. The legs 15, 16 each have a passage 17 for reception of a locking element (FIGS. 2A and 2B), which is not illustrated, the passage 17 in FIGS. 1A and 1B extending from the front to the rear.

In this embodiment the base body has at each of its ends on the left and right in FIGS. 1A and 1B two passages 18 for reception of a fastener (FIGS. 3, 4), which is not illustrated, for polarity resistors. Each passage 18 extends from the first to the second support region 11, 12. In addition, the body has between its ends on the left and right in FIGS. 1A and 1B three passages 18' for reception of a polarity contact (FIG. 5), which is not illustrated, or other components. Each passage 18' extends from the first to the second support region 11, 12.

Figure 2A:
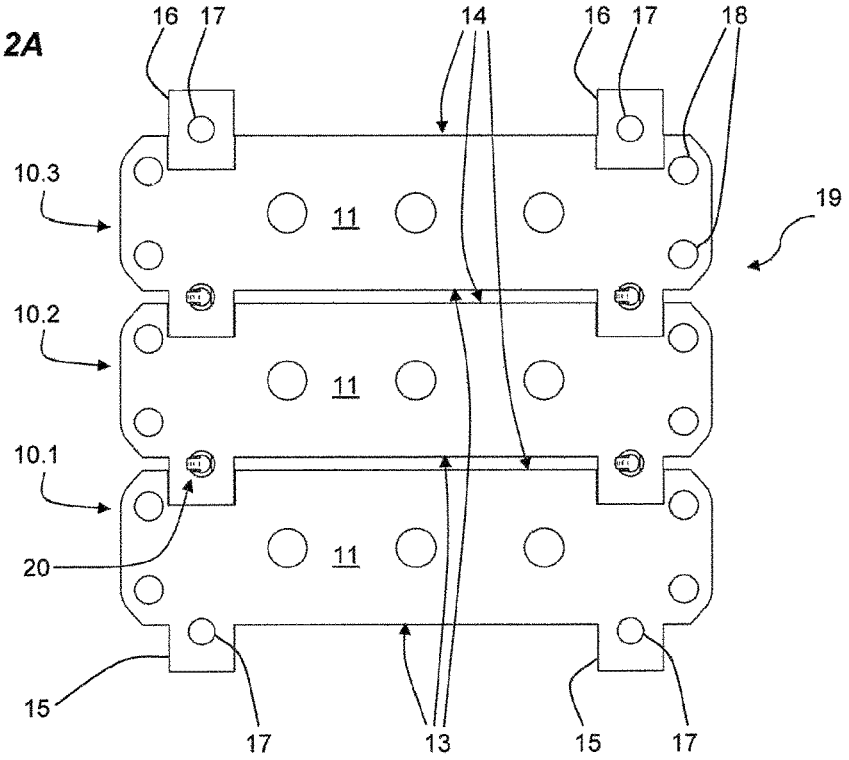
FIGS. 2A and 2*b* are side and perspective views of an embodiment of a support structure for polarity resistors of a tap changer.
Figure 2B:
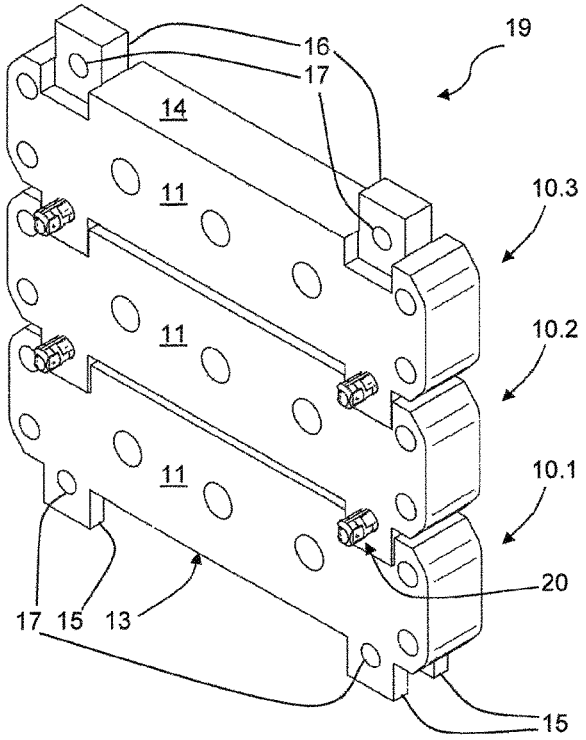

One embodiment of a support structure 19 for polarity resistors (FIGS. 3A and 3B), which are not illustrated, of a tap changer (not illustrated) is schematically illustrated in FIGS. 2A and 2B. The support structure 19 comprises three support modules 10.1, 10.2, 10.3 that in this embodiment are constructed like the support modules 10 according to the first embodiment.

The support modules 10.1, 10.2, 10.3 are joined with the second connecting face 14 of the first support module 10.1 at least partly bears against the first connecting face 13 of the second support module 10.2, namely in the region of the keys or legs 16 of the first support module 10.1 and in the region of the grooves between the legs 15 of the second support module 10.2, and in that the second connecting face 14 of the second support module 10.2 at least partly bears against the first connecting face 13 of the third support module 10.3, namely in the region of the keys or legs 16 of the second support module 10.2 and in the region of the grooves between the legs 15 of the third support module 10.3. When the support modules 10.1, 10.2, 10.3 are correctly joined or assembled, then the passages 17 are aligned in the respectively associated legs 15, 16 and a respective locking element 20 can be pressed into the aligned passages 17.

In this embodiment each [passage 17] is constructed as a grooved pin and consists of injection-molded PE. It is seated with a press fit in the associated aligned passages 17 and thus engages the two adjacent joined support modules 10.1 and 10.2 or 10.2 and 10.3 in such a way that it prevents detaching of these support modules.

Figure 3A:
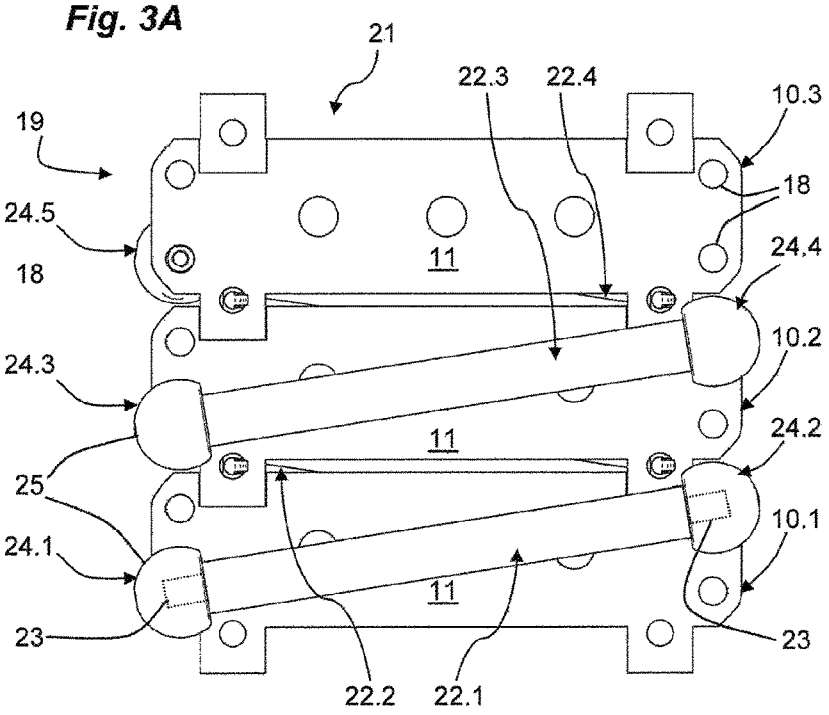
FIGS. 3A and 3B are side and perspective views of a first embodiment of an assembly of polarity resistors of a tap changer.
Figure 3B:
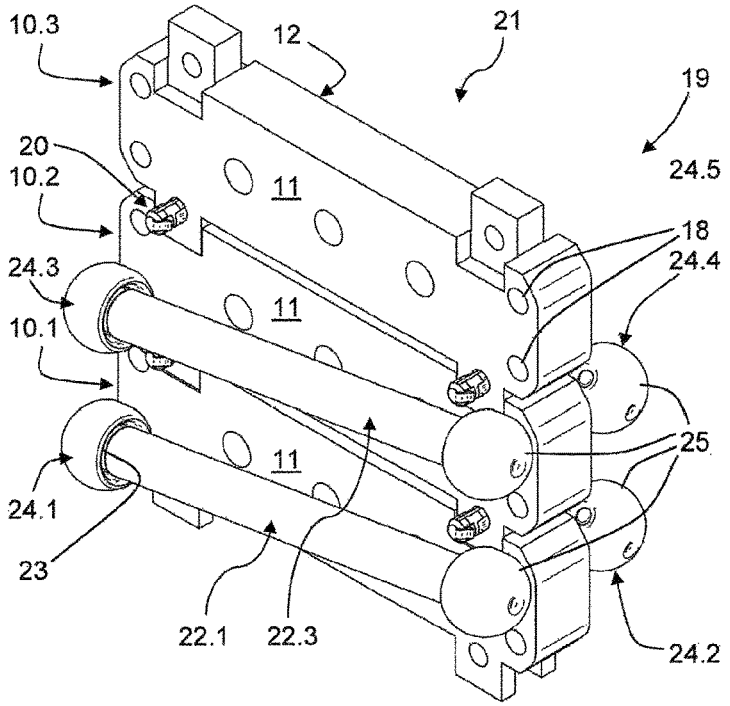

A first embodiment of an assembly 21 of polarity resistors 22 of a tap changer (not illustrated) is schematically illustrated in FIGS. 3A and 3B. The assembly 21 is here constructed by way of example as a single-phase assembly 21 and comprises a support structure 19 that in this embodiment is constructed as the support structure 19 in accordance with the second embodiment, four polarity resistors 22.1, 22.2, 22.3, 22.4 that each have two electrically conductive ends 23, and five fasteners 24.1, 24.2, 24.3, 24.4, 24.5. The ends 23 cannot be seen here, since they lie in the interior of the fasteners 24.

In this embodiment the first polarity resistor 22.1 is fastened to the first support region 11 of the first support module 10.1, the second polarity resistor 22.2 is fastened to the second support region 12 of the first support module 10.1 and to the second support region 12 of the second support module 10.2, the third polarity resistor 22.3 is fastened to the first support region 11 of the second support module 10.2 and the fourth polarity resistor 22.4 is fastened to the second support region 12 of the second support module 10.2 and to the second support region 12 of the third support module 10.3.

Each fastener 24 has two electrically conductive sockets 25 that each have a seat for an end 23 of one of the polarity resistors 22, and an electrically conductive connecting section 26 (FIGS. 4A and 4B), which is not illustrated and that mechanically and electrically connects the two sockets 25 together. The connecting section 26 cannot be seen here, since it lies in the passages 18 of the support modules 10. The fasteners 12 are described in more detail further below.

The fasteners 24 are associated with the polarity resistors 22 in pairs, namely the first and second fasteners 24.1, 24.2 with the first polarity resistor 22.1, the second and third fasteners 24.2, 24.3 with the second polarity resistor 22.2, the third and fourth fasteners 24.3, 24.4 with the third polarity resistor 22.3 and the fourth and fifth fasteners 24.4, 24.5 with the fourth polarity resistor 22.4. Thus, two fasteners 24 are provided for each polarity resistor 22.

In this embodiment the first fastener 24.1 is received by its connecting section 26 in the passage 18 of the first support module 10.1 at the lower left in FIGS. 3A and 3B, the second fastener 24.2 is received by its connecting section 26 in the passage 18 of the first support module 10.1 at the upper right in FIGS. 3A and 3B, the third fastener 24.3 is received by its connecting section 26 in the passage 18 of the second support module 10.2 at the lower left in FIGS. 3A and 3B, the fourth fastener 24.4 is received by its connecting section 26 in the passage 18 of the second support module 10.2 at the upper right in FIGS. 3A and 3B and the fifth fastener 24.5 is received by its connecting section 26 in the passage 18 of the third support module 10.3 at the lower left in FIGS. 3A and 3B. Thus, each polarity resistor 22 is fastened by its ends 23 to the support structure 19 in each instance by way of two fasteners 24. Thus, in addition, the first end 23 of the second polarity resistor 22.2 at the right in FIGS. 3A and 3B lies closer to the second end 23 of the first polarity resistor 22.1 at the right in FIGS. 3A and 3B than to the first end 23 of the first polarity resistor 22.1 at the left in FIGS. 3A and 3B and is electrically connected by way of the second fastener 24.2 to this second end 23. Thus, in addition, the second end 23 of the second polarity resistor 22.2 at the left in FIGS. 3A and 3B lies closer to the first end 23 of the first polarity resistor 22.1 than to the second end 23 of the first polarity resistor 22.1. Thus, in addition, the first end 23 of the third polarity resistor 22.3 at the left in FIGS. 3A and 3B lies closer to the second end 23 of the second polarity resistor 22.2 than to the first end 23 of the second polarity resistor 22.2 and is electrically connected by way of the third fastener 24.3 to this second end 23. Thus, in addition, the second end 23 of the third polarity resistor 22.3 at the right in FIGS. 3A and 3B lies closer to the first end 23 of the second polarity resistor 22.2 than to the second end 23 of the second polarity resistor 22.2. Thus, in addition, the first end 23 of the fourth polarity resistor 22.4 at the right in FIGS. 3A and 3B lies closer the second end 23 of the third polarity resistor 22.3 than to the first end 23 of the third polarity resistor 22.3 and is electrically connected by way of the fourth fastener 24.4 to this second end 23. Thus, in addition, the second end 23 of the fourth polarity resistor 22.4 at the left in FIGS. 3A and 3B lies closer to the first end 23 of the third polarity resistor 22.3 than to the second end 23 of the third polarity resistor 22.3. Consequently, the polarity resistors 22 are connected in series and arranged in meandering manner or zigzag form at the support structure 19.

Figure 4A:
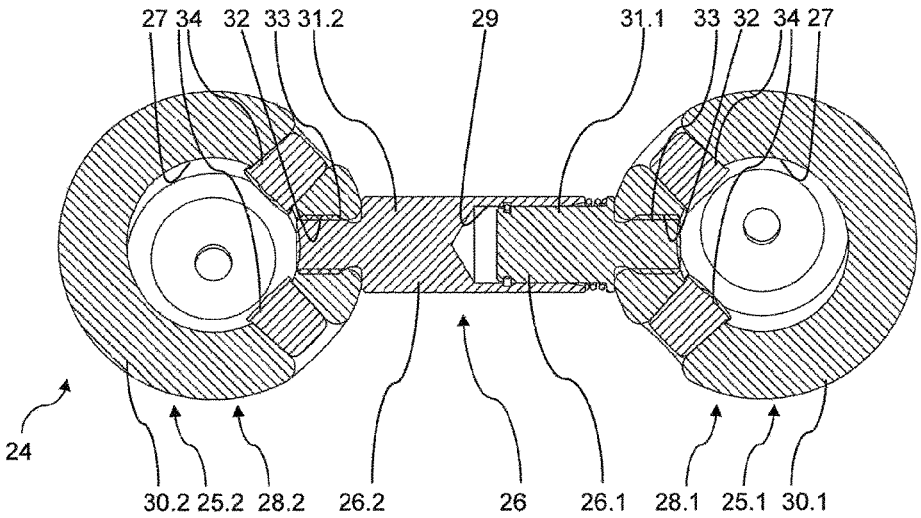
FIGS. 4A and 4*b* are sectional and exploded perspective views of an embodiment of a fastener for polarity resistors.
Figure 4B:
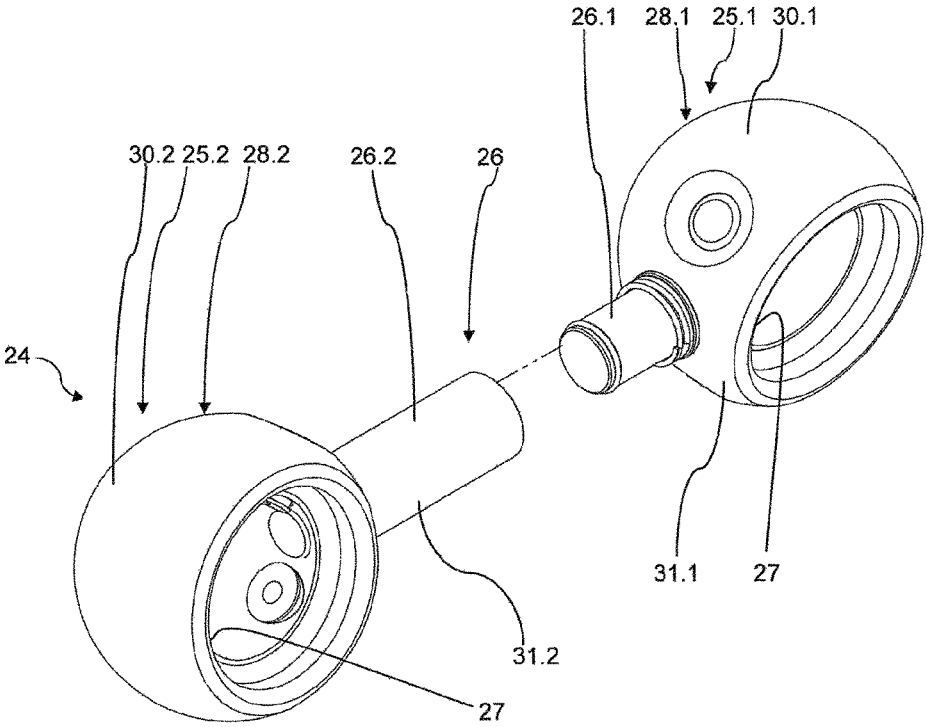

One embodiment of a fastener 24 for polarity resistors 22 (FIGS. 3A and 3B), which are not illustrated and that each have two electrically conductive ends 23, is schematically illustrated in FIGS. 4A and 4B. The fasteners 24 of the assembly 21 of FIGS. 3A and 3B can, for example, be constructed like this embodiment.

The fastener 24 has two electrically conductive sockets 25.1, 25.2 that each have a seat 27 for one of the ends 23 of a polarity resistor 22, an electrically conductive connecting section 26, a first portion 28.1 and a second portion 28.2. The connecting section 26 mechanically and electrically connects together the two sockets 25. The first portion 28.1 includes the first socket 25.1 and a first part 26.1 thereadjacent of the connecting section 26. The second portion 28.2 includes the second socket 25.2 and a second part 26.2 thereadjacent of the connecting section 26.

In this embodiment the free end that is remote from the first socket 25.1 and on the left in FIGS. 4A and 4B, of the first part 26.1 is formed as a cylindrical stud and the free end that is remote from the second socket 25.2 and on the right in FIGS. 4A and 4B, of the second part 26.2 has a cylindrical blind bore 29 for receiving the stud with a clearance fit. The first and second parts 26.1, 26.2 of the connecting section 26 are thus constructed as a plug connection. A respective encircling groove, in which a spring ring is seated when the parts 26.1, 26.2 are correctly plugged together, is formed in the circumferential surface of the stud and in the circumferential wall of the blind bore 29.

In this embodiment the first portion 28.1 comprises a socket body 30.1 that includes the first socket 25.1, and a connecting member 31.1 that includes the first part 26.1 of the connecting section 26. The second portion 28.2 comprises a socket body 30.2 that includes the second socket 25.2, and a connecting member 31.2 that forms the second part 26.2 of the connecting section 26. In each portion 28 the respective socket body 30 has a passage 32 with an internal thread and the free end that is near this socket body 30, of the respective connecting member 31 is formed as a stud with an external thread for engagement in the internal thread. Each connecting member 31.1, 31.2 is thus fastened to the respective socket body 30.1, 30.2 by a screw connection.

In each portion 28 the respective passage 32 opens into the respective seat 27 and is shorter than the stud 33 of the respective connecting member 31. The stud 33 can thereby be screwed to such an extent into the passage 32 that it projects by its free end into the seat 27 and bears against an end 23, which is pushed into the seat 27, of a polarity resistor 22 (FIGS. 3A and 3B), which is not illustrated, so as to firmly clamp this in the socket body 30.

In this embodiment each socket body 30 has two additional passages, in each of which is seated a resilient or elastic thrust member 34 that is biased radially inwardly and bears against an end 23 that is pushed into the seat 27, of a polarity resistor 22 (FIGS. 3A and 3B), which is not illustrated, so as to firmly clamp this in the socket body 30.

Figure 5:
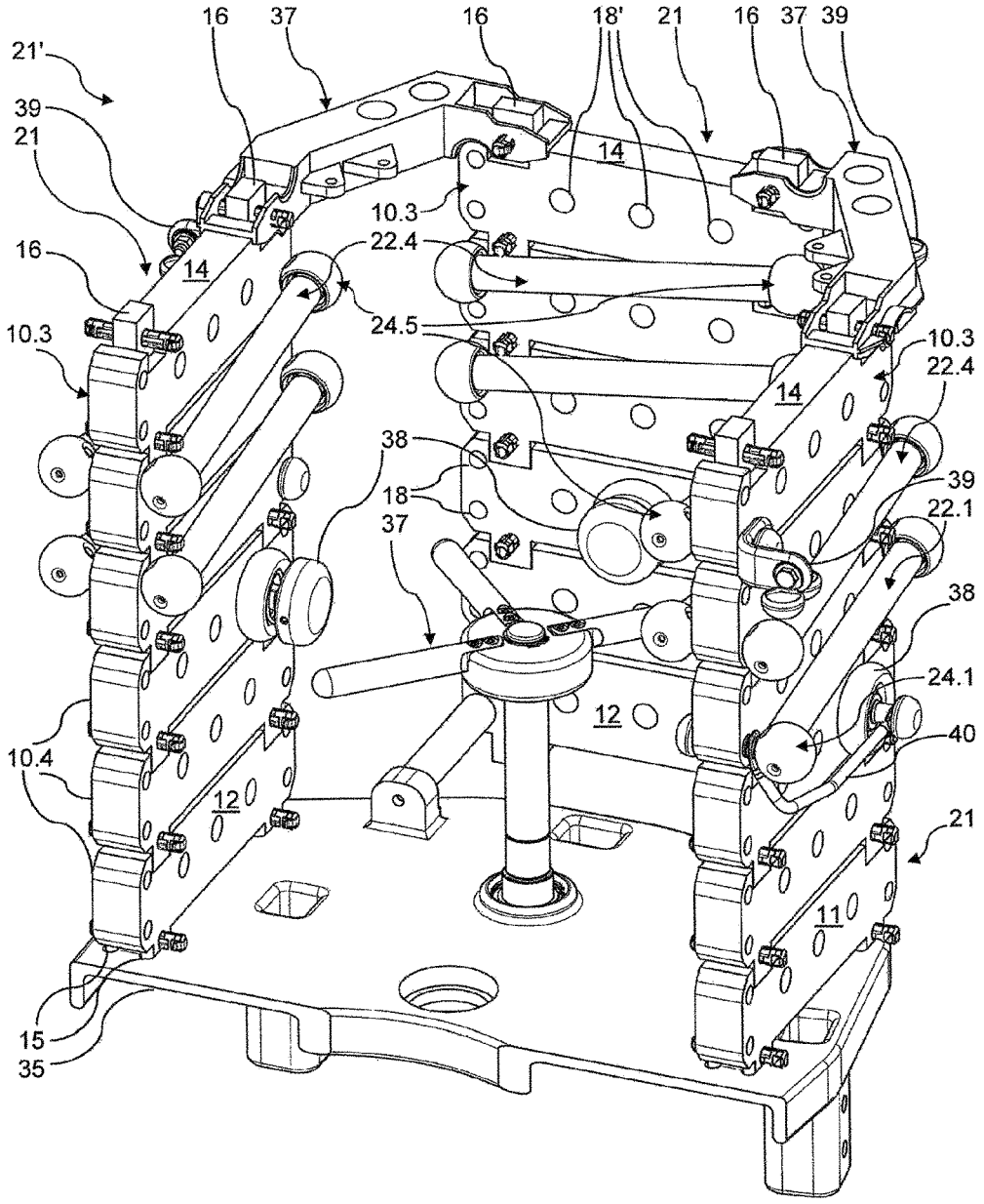
FIG. 5 is a perspective view of a second embodiment of an assembly of polarity resistors of a tap changer.

A second embodiment of an assembly 21' of polarity resistors 22 of a tap changer (not illustrated) is schematically illustrated in FIG. 5. The assembly 21' is here constructed, by way of example, as a three-phase assembly 21' and has three single-phase assemblies 21, which are in U-shape, a base plate 35, two stabilizing struts 36 and a movable triple-arm polarity contact 37. Each of the single-phase assemblies 21 is constructed in accordance with a third embodiment that is similar to the first embodiment so that in the following merely the differences are described in detail.

Each single-phase assembly 21 comprises a fixed polarity contact 38, a connecting contact 39 and three additional support modules 10.4 that are below the respective first support module 10.1, wherein the uppermost of these additional support modules 10.4 is fastened to the first support module 10.1. The respective lowermost one of these additional support modules 10.4 is fastened to the base plate 35. For that purpose, the base plate 35 has on the one hand, in the region of the assembly 21 on the left and right in FIG. 5, upwardly projecting legs that correspond with the legs 16 of the second connecting faces 14 and are seated in the grooves between the legs 15 of the first connecting face 13 of the respective lowermost one of these additional support modules 10.4. For this purpose the base plate 35 has on the other hand, in the region of the assembly 21 at the rear in FIG. 5, two rearwardly projecting struts that are received in the lower passages 18 of the support regions 11, 12 of the lowermost one these additional support modules 10.4 and are fastened thereto.

In each of the single-phase assemblies 21 the fixed polarity contact 38 is received in one of the passages 18' of the support regions 11, 12 of the respective uppermost one of the additional support modules 10.4 and fastened thereto and the connecting contact 39 is fastened, similarly to a socket body 30, on the end of that fastener 24 that holds the second end of the fourth polarity resistor 22.4 at the third support module 10.3. Each fixed polarity contact 38 is electrically connected by way of a line 40 with the first fastener 24.1 and thus with the first end of the respective first polarity resistor 22.1.

The base plate 35 has in the center a passage in which a perpendicular leg of the movable polarity contact 37 is pivotably or rotatably mounted. The movable polarity contact 37 additionally has three horizontal contact fingers that lie at the level of the fixed polarity contacts 38 and that can be brought into contact with the fixed polarity contacts 38 by pivoting or rotation of the movable polarity contact 37.

The stabilizing struts 36 are fastened to the third support modules 10.3 in that similarly to a first connecting face 13 they are fastened by their ends to the legs 16 of the respective third support module 10.3.

The invention claimed is:

1. An assembly of polarity resistors of a tap changer, the assembly comprising:
- two polarity resistors that each have two electrically conductive ends; and
- a support structure that comprises two support modules each having:
  - a first support region for at least one polarity resistor;
  - a second support region for at least one polarity resistor;
  - a first connecting face; and
  - a second connecting face that fits the first connecting face;

wherein:
- the support modules are joined with the second connecting face of the first support module at least partly bearing against the first connecting face of the second support module;
- in each support module the connecting faces are on opposite sides of the support module;
- in each support module the support regions are on opposite sides of the support module;
- in each support module each support region is between the connecting faces and/or connects together the connecting faces;
- the first polarity resistor is fastened to the first support region of the first support module;
- the second polarity resistor is fastened to the second support region of the first support module and/or the second support region of the second support module;
- the first end of the second polarity resistor lies closer to the second end of the first polarity resistor than to the first end of the first polarity resistor and is connected with this second end; and
- the second end of the second polarity resistor lies closer to the first end of the first polarity resistor than to the second end of the first polarity resistor.

2. The assembly according to claim 1, wherein:
- each polarity resistor is fastened by its ends to the support structure.

3. The assembly according to claim 2, comprising:
- for each polarity resistor, two fasteners each comprising:
  - two electrically conductive sockets each having a seat for an end of one of the polarity resistors; and
  - an electrically conductive connecting section that mechanically and electrically connects the two sockets together;

wherein:
- each support module has two passages that each extend from the first to the second support region and can receive the connecting section of one of the fasteners in such a way that the first socket of the fastener lies in the first support region of the support module and the second socket of the fastener lies in the second support region of the support module.

4. The assembly according to claim 3, wherein:
- a first and a second fastener are received in the passages of the first support module;
- a third fastener is received in one of the passages of the second support module;

the first polarity resistor is seated by its first end in the first seat of the first fastener and by its second end in the first seat of the second fastener; and the second polarity resistor is seated by its first end in the second seat of the second fastener and by its second end in the second seat of the third fastener.

5. The assembly according to claim 1, wherein:

a first and a second fastener are received in the passages of the first support module;

a third and a fourth fastener are received in the passages of the second support module;

the first polarity resistor is seated by its first end in the first seat of the first fastener and by its second end in the first seat of the second fastener;

the second polarity resistor is seated by its first end in the second seat of the third fastener and by its second end in the second seat of the fourth fastener; and the third fastener is connected with the second fastener.

* * * * *